US005742967A

United States Patent [19]

Giessler

[11] Patent Number: 5,742,967

[45] Date of Patent: Apr. 28, 1998

[54] UTILITY VEHICLE SWEEPING DEVICE

[76] Inventor: Matthias Giessler, Schlehenweg 8, 77933 Lahr, Germany

[21] Appl. No.: 602,314

[22] Filed: Feb. 16, 1996

[30] Foreign Application Priority Data

Feb. 18, 1995 [DE] Germany ..... 295 02 694 U

[51] Int. Cl.[6] ..... E01H 1/05

[52] U.S. Cl. ..... 15/82; 15/340.3; 37/241; 37/248

[58] Field of Search ..... 37/238, 240–242, 37/248, 252; 15/55, 82, 83, 340.3, 340.4

[56] References Cited

U.S. PATENT DOCUMENTS

| | | | |
|---|---|---|---|
| 2,911,737 | 11/1959 | Von Arx | 15/83 |
| 3,034,236 | 5/1962 | Pyke | 15/82 |
| 4,809,380 | 3/1989 | VanGinhoven et al. | 15/83 |
| 5,249,332 | 10/1993 | Wilkerson . | |
| 5,579,553 | 12/1996 | Holley | 15/55 |

FOREIGN PATENT DOCUMENTS

| | | | |
|---|---|---|---|
| 3643080 | 6/1988 | Germany | 15/82 |
| 40 22 390 | 7/1990 | Germany . | |
| 40 22 390 C2 | 4/1992 | Germany . | |
| 666711 | 8/1988 | Switzerland | 15/82 |
| 1052608 | 11/1983 | U.S.S.R. | 15/83 |

*Primary Examiner*—Terrence Till
*Attorney, Agent, or Firm*—McGlew and Tuttle

[57] ABSTRACT

Sweeping devices for utility vehicles with a rotatingly driven bristle roller have been known, which are covered on the top side by a protective housing and in front of which a feed screw extending in parallel to the bristle roller is arranged, and the feed screw is arranged, drivable by a motor, in a sweepings collection housing, which is provided with a rear charging opening and with a discharge opening at the end of the screw, wherein the sweepings collection housing has an obliquely downwardly directed baffle plate with a flexible bottom plate under its charging opening. To improve the mode of operation and the sweeping performance, especially at higher speeds of travel, the bristle roller is driven at such a speed of rotation that in the area located between it and the charging opening of the sweepings collection housing, it generates an air flow, which continues into the discharge opening of the sweepings collection housing, which is designed as a feed cup and a flow channel at the same time.

20 Claims, 6 Drawing Sheets

Fig.8
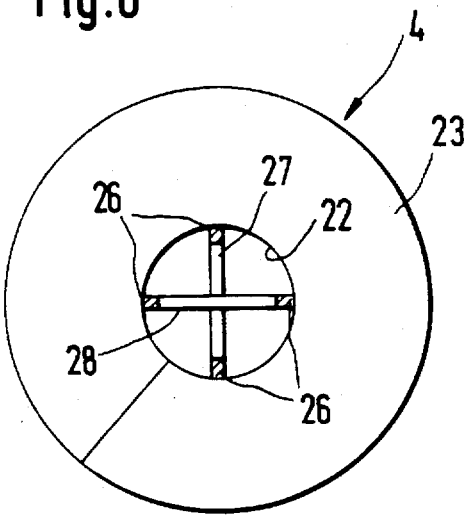
Fig.10
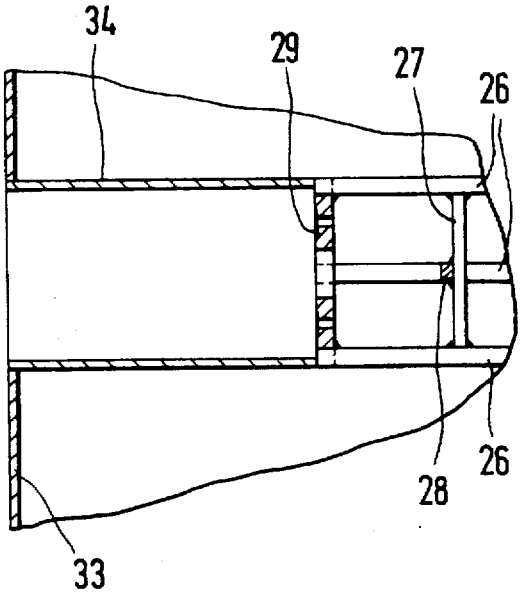
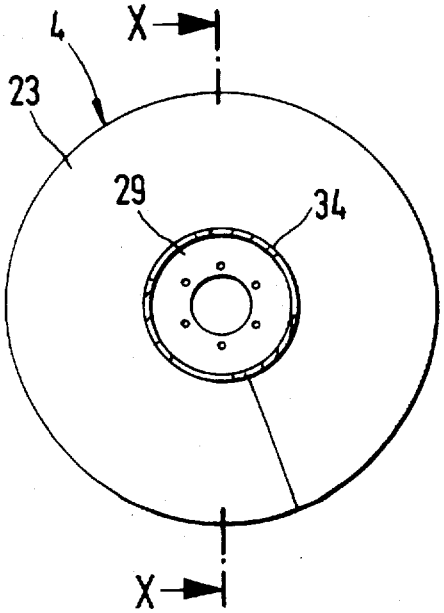
Fig.9
Fig.11
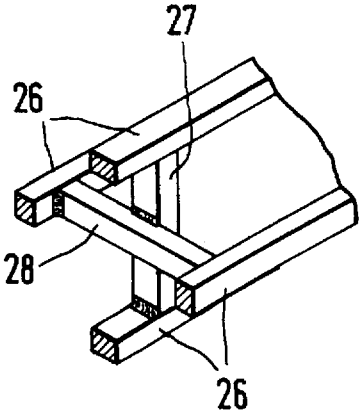

UTILITY VEHICLE SWEEPING DEVICE

FIELD OF THE INVENTION

The present invention pertains to a sweeping device for utility vehicles for cleaning traffic areas with a rotating bristle roller, which is driven by a motor and is covered by a protective housing on the top side, as well as with a feeding means, which is arranged directly in front of it in the direction of travel and comprises a feed screw, which extends in parallel to the sweeping roller and is arranged, likewise drivable by a motor, in a sweepings collection housing provided with a rear charging opening extending over the length of the bristle roller and with a discharge opening at the end of the screw, wherein the sweepings collection housing has an obliquely downwardly directed baffle plate with a flexible bottom strip under its charging opening, and a gap between the protective housing of the sweeping roller and the sweepings collection housing is closed by a cover.

BACKGROUND OF THE INVENTION

An attached snow plow for trucks has already been known (DE 40 22 390 C2), in which a feed screw, which conveys the sweepings picked up laterally to the outside, is arranged between the plow blade and a motor-driven sweeping roller extending in parallel to it. The feed screw is located in a feeding trough, whose wall, having a semicircular cross section, begins directly on the rear side of the snow plow above the axis of the feed screw and ends at an approximately diametrically opposite end edge. An obliquely downwardly directed baffle plate with a flexible bottom strip is fastened to the end edge. The sweepings collection housing, whose lower part is formed by the feeding trough, additionally has an obliquely upwardly extending baffle, which begins from the feeding trough on the rear side of the snow plow and ends at an upper cover plate, which is located at a vertical distance from the feed screw approximately corresponding to half the diameter of the feed screw and lies on a top-side cover of the sweeping roller.

This sweeping device can be used only in combination with the snow plow arranged in front, which always assumes an oblique position in relation to the direction of travel. It is also fastened to the snow plow such that it is always in parallel to this. The sweeping device is therefore also arranged such that its feed screw can feed optionally in one direction or another, and the two side walls carrying the collection housing have discharge openings for the sweepings being conveyed from the feed screw to the discharge side actually set.

This sweeping device is said to make possible the so-called "black clearing" of streets in the winter, where the sweeping device has the task of picking up the residues of snow not caught by the snow plow and conveying it to the same side as the obliquely positioned snow plow.

During the operation of these prior-art sweeping devices, the sweeping roller is driven at a relatively low speed of rotation, which is between 150 rpm and 250 rpm, depending on the roller diameter, partly in order not to subject the bristles of the sweeping roller to excessive wear, and partly because the speed of rotation is sufficient to throw the sweepings caught by the sweeping roller into the feeding trough of the feed screw.

Since the feeding trough is open on both front sides to enable the sweepings picked up to be removed optionally on one side or another, it should be ensured in this prior-art sweeping device that an air flow, however weak, which is generated by the rotation of the sweeping roller, will not generate an air flow leaving the collection housing laterally. Such an air flow is also avoided especially by the collection housing having a relatively large hollow space above the feed screw, and by the working speed of rotation of the feed screw being kept relatively low. However, the low speed of rotation of the feed screw means a relatively low work performance or a reduction in the mode of operation of the sweeping roller to a purely mechanical separation, picking up and throwing of the sweepings into the area of the feeding trough or the feed screw. Speeds of travel of at most 3 km/hour to 7 km/hour are common during the use of the sweeping device.

SUMMARY AND OBJECTS OF THE INVENTION

The basic object of the present invention is to improve the mode of operation and the sweeping performance of a sweeping device of the type mentioned in the introduction such that perfectly clear areas are obtained, especially at higher speeds of travel of the utility vehicle equipped with the sweeping device, optionally in combination with a clearing plow blade arranged in front of it, e.g., a snow plow or the like, both during the cleaning of dirty traffic areas and during the clearing of streets or other traffic areas from snow in winter.

This object is accomplished according to the present invention by the bristle roller having an initial diameter of about 30 cm to 100 cm and an initial bristle length of about 10 cm to 40 cm being driven at such a speed of rotation that in the area located between it and the charging opening of the sweepings collection housing, it generates an air flow which continues up to the discharge opening of the sweepings collection housing in the sweepings collection housing, which is designed as a feed cup and a flow channel at the same time.

The mode of operation of the sweeping roller is expanded due to the solution to the object according to the present invention by an additional aerodynamic component, which exerts—in the section of the traffic area being treated located between the sweeping level of the sweeping roller and the bottom strip of the collection housing—the effect of a blower, by which loose sweepings are blown into the collection housing shown even before they come into contact with the bristles of the sweeping roller and are carried by the air flow still continuing to prevail there to the discharge opening. Sweepings of a coarser particle size or higher specific gravity, such as grit, fine gravel, sand, or the like, will be deposited somewhere in the area of the feed screw within the collection housing, to be conveyed by the feed screw to the discharge opening, while fine granular, lightweight sweepings are blown directly to the discharge opening.

The feed screw of the sweeping device of the invention preferably includes a radial sheet metal coil which is wound around a central, cylindrical hollow space and is surrounded over its entire length at a short radial distance from it via a cylindrical closed jacket tube. The charging opening of the jacket tube extends over at least ⅕ of the circumference of the jacket tube.

A vertical dimension H of the charging opening preferably approximately corresponds to the initial bristle length. The lower limiting edge of the charging opening is preferably located at a level of the lowest point of the jacket tube and the upper limiting edge of the charging opening is preferably arranged approximately at the level of the screw axis.

The working speed of rotation of the bristle roller is preferably above a threshold value of about 350 rpm. The working speed of rotation of the feed screw preferably approximately corresponds to half the working speed of rotation of the bristle roller.

The feed screw preferably has an external diameter (D2) that corresponds at least to ¾ of the initial diameter (D1) of the bristle roller. The diameter (D3) of the hollow space surrounded by the screw coil preferably corresponds to about ⅓ of the external diameter (D2) of the feed screw.

The side of the front-side discharge opening of the sweepings collection housing is at least as large as half of its cross-sectional area. At least the closed front wall of the sweepings collection housing, located at the beginning of the delivery of the feed screw, has at the level of the charging opening an extension. The extension is directed toward the lower area of the bristle roller and closes the space located between the bristle roller and the charging opening on the front side at least for the most part.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 8 is a section VIII—VIII from FIG. 7;

FIG. 9 is a section IX—IX from FIG. 7;

FIG. 10 is a section X—X from FIG. 9; and

FIG. 11 is a perspective view of a cross connection of the stabilizer bars arranged in the feed screw.

DESCRIPTION OF THE PREFERRED EMBODIMENT

Figure 1:
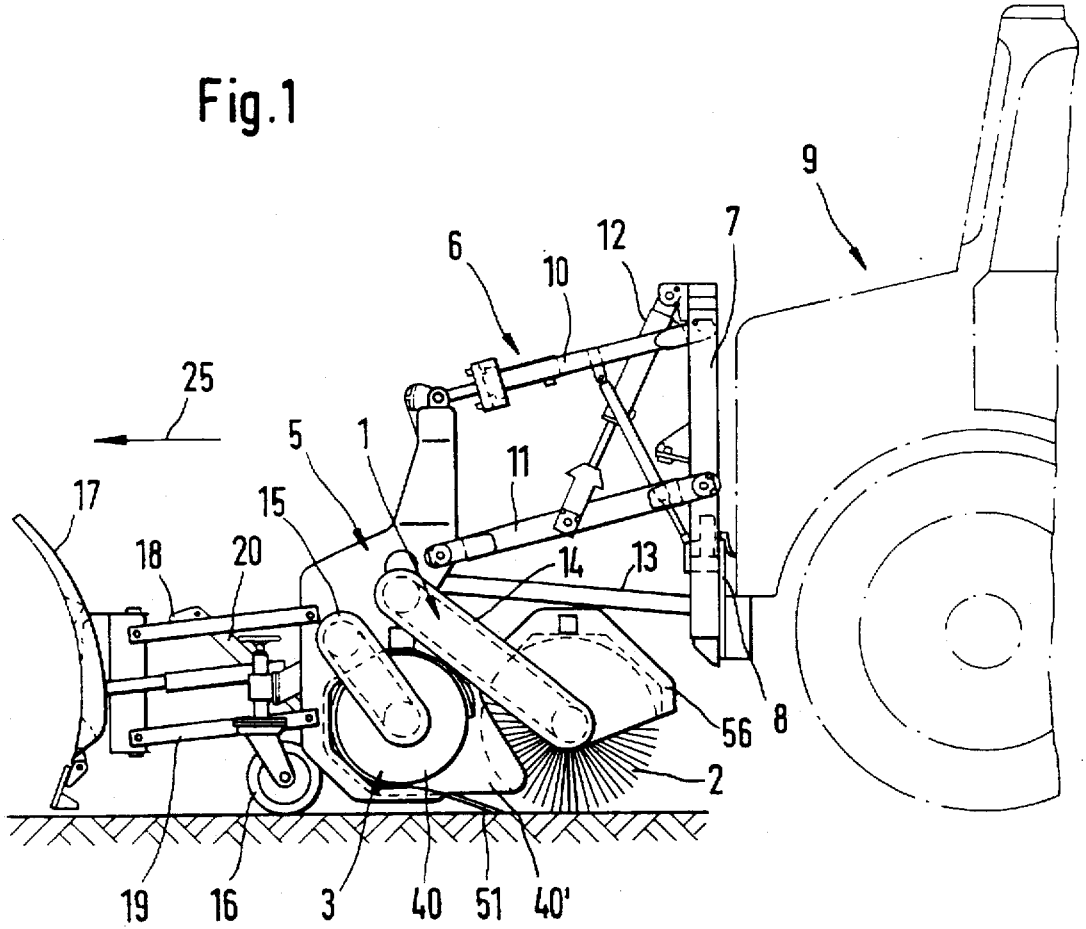
FIG. 1 is a side view of a sweeping device optionally provided with a snow plow arranged in front of it.

The sweeping device 1 shown in the drawings comprises a motor-driven, rotating bristle roller 2 and a feed screw 4, which is arranged in a sweepings collection or feed housing 3 in parallel to the bristle roller 2 arid is likewise motor-driven.

The bristle roller 2 and the sweepings collection housing 3 with the feed screw 4 mounted rotatably in it are together fastened to a support frame 5, which is fastened vertically movably on a vertical support structure 7 of the front-side base 8 of a utility vehicle 9 by means of a supporting device 6. The bristle roller 2 is located, relative to the direction of travel indicated by the arrow 25, directly behind the feed screw 4. The supporting device 6 comprises two parallel connecting rod pairs 10 and 11, each of which is linked to the support frame 5, on the one hand, and to the support structure 7, on the other hand. The sweeping device 1 can be raised by means of a hydraulic lifting cylinder 12 from the working position shown in FIG. 1 and FIG. 2 into a transport position. In the working position shown in FIG. 2, the bristle roller is located, in the area of a so-called sweeping level 24, on a traffic area 52, whose width S may be about 10 cm to 25 cm, depending on the selectable setting. Both the bristle roller 2 and the feed screw 4 are driven in the exemplary embodiment from the utility vehicle via a clutch shaft 13 coupled with the power take-off shaft of the utility vehicle 9 and a distributor gear, not shown, as well as via two separate belt drives 14 and 15, which are arranged on the same front side.

A snow plow 17, which is likewise connected by two parallel connecting rod pairs 18 and 19 to the support frame 5 in a height-adjustable manner and can be set in the vertical direction separately, i.e., relative to the support frame 5, by means of an obliquely linked hydraulic cylinder 20, is additionally arranged in the exemplary embodiment shown in FIG. 1 on the front side on the support frame 5, which is usually provided with two running wheels 16. Instead of a snow plow 17, it would also be possible to use a low plow blade for clearing away coarse sweepings, e.g., larger stones, lumps of earth, lumps of ice, etc.

Figure 2:
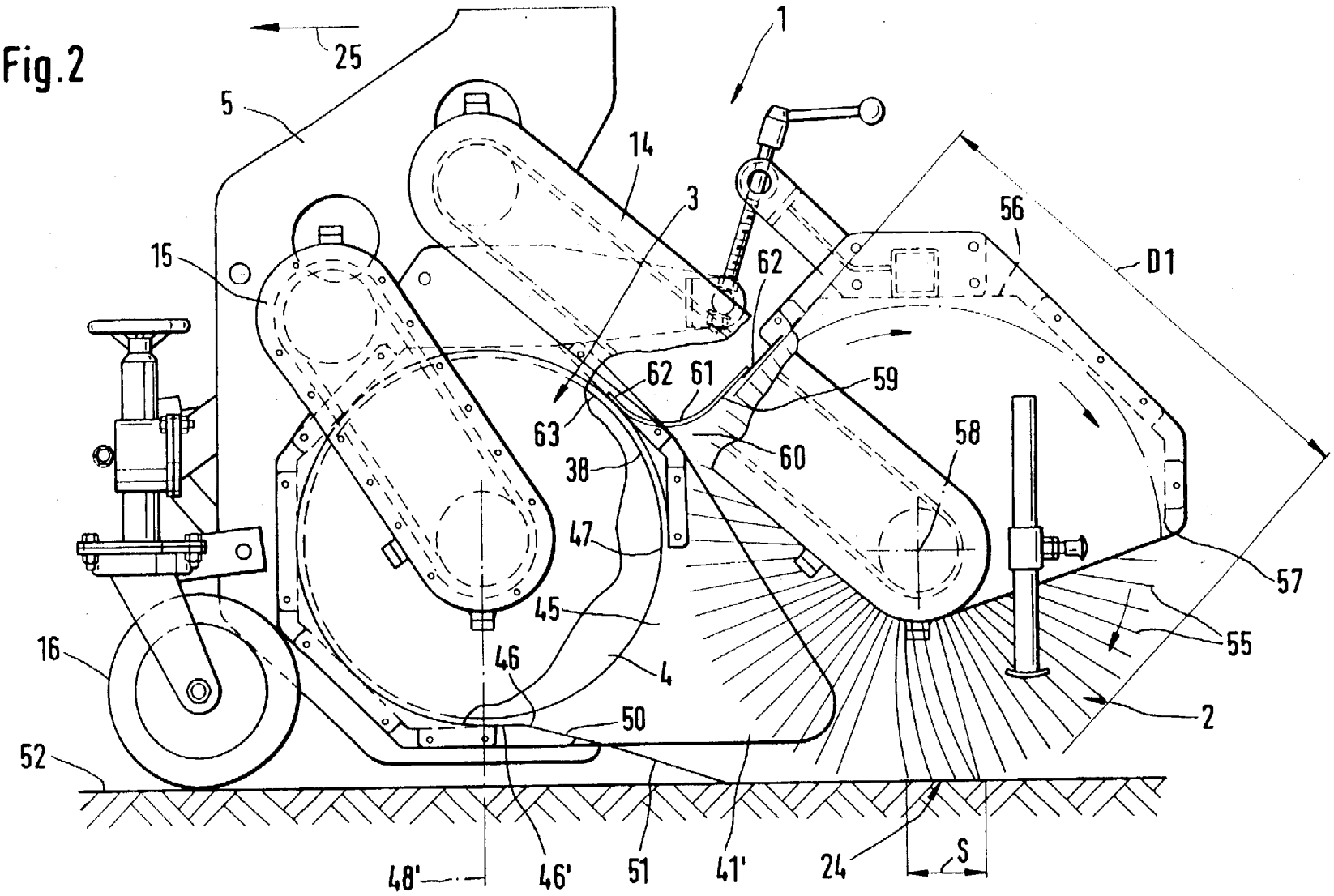
FIG. 2 is a partially cutaway side view of the sweeping device without snow plow and without supporting device.

However, as is shown in FIG. 2, the sweeping device may also be used without a plow blade or scraping strip for cleaning, e.g., streets blocked by dirt left by construction equipment. It may even be assumed that this type of use will be the predominant one.

The bristle roller 2 and the feed screw 4 rotatably mounted in the sweepings collection housing 3 are arranged extending in parallel to one another such that their axes extend at right angles to the direction of travel 25 of the utility vehicle 9. Their axial lengths, which are approximately equal, are selected to be such that they extend at least over the width of the utility vehicle. Their axial length may be 1 m to 4 m or more, depending on the particular application. About 2.5 m is common for street cleaning. In a preferred embodiment, the bristle roller has an initial diameter D1 of about 60 cm at a bristle length of about 20 cm. The feed screw 4, consisting of a radial sheet metal coil 23 wound around a central, quasi-cylindrical hollow space 22, has a diameter D2 of 45 cm, and the diameter D3 of the quasi-cylindrical hollow space of the sheet metal coil 23 is about 16 cm. Thus, the screw diameter D2 corresponds to three fourths the bristle roller initial diameter DI. The screw diameter should not be smaller. Greater screw diameters make possible higher feed capacities or a higher sweepings throughput, but doing so at the expense of saving weight. A D1:D2 ratio of 1:1 could be considered to be optimal at the bristle roller size indicated here.

However, it is also possible, in general, to use bristle rollers 2 with initial diameters DI of about 30 cm to 100 cm and with initial bristle lengths of 10 cm to 40 cm.

To radially stabilize the sheet metal coil 23 against sagging, four axial stabilizer bars 26, which are connected to one another in pairs and crosswise by a plurality of radial bars 27 and 28 welded together crosswise, are arranged in the cylindrical hollow space 22. At the drive-side end section of the feed screw 4, these stabilizer bars 26 end at a radial clutch disk 29, to which they are welded individually, while the opposite ends of the stabilizer bars 26 are fastened to the circumference of two radial bearing disks 30 and 31, which are arranged at a short axial distance from one another and carry a central axle journal 32. A coaxial pipe section 34, in which a clutch, not shown, is arranged, which is nonrotatably connected to the clutch disk 29 and via which the feed screw 4 is driven by the belt drive 15, is arranged between the clutch disk 29 and a radial, circular end plate 33.

The sheet metal coil 23 is welded to the pipe section 34, on the one hand, and, on the other hand, it is multiply welded to the stabilizer bars 26, as a result of which it acquires sufficient dimensional stability over its entire length.

The quasi-cylindrical hollow space 22, which is surrounded by the sheet metal coil 23, is interrupted between the clutch disk 29 and the bearing disk 30 arranged at the other end of the feed screw only by the stabilizer bars 26 and the radial bars 27 and 28, whose cross sections are, however, so small that they offer only little resistance to an air flow passing through this hollow space.

The sweepings collection housing 3 comprises a cylindrical jacket tube 38, which is surrounded by a rectangular sheet metal wall 39. This jacket tube 38 surrounds the feed screw 4 at a short radial distance, which may be as little as a few mm. On the drive-side front or end side, this jacket tube 38 is completely closed by a front or side wall 40, except for a central passage opening for the drive elements. Even though another front or side wall 41 is also provided on the opposite front or end side, this has a discharge opening 42 extending over a center square $\alpha$ of about 240° to 250°, through which the feed screw 4 removes the sweepings picked up to the outside. This discharge opening 42 should always have a size corresponding at least to half the cross-sectional area of the sweepings collection housing 3/38.

Figure 3:
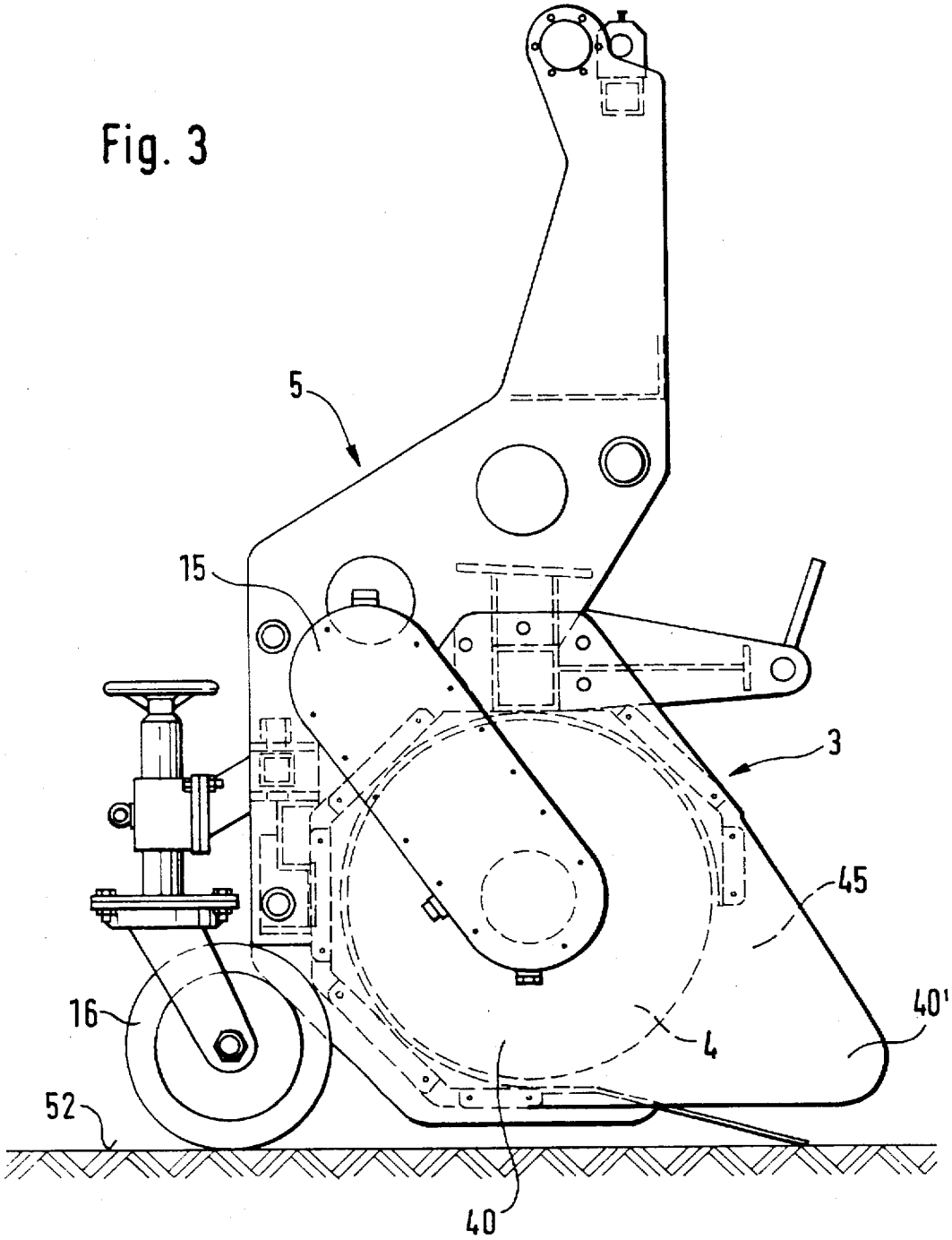
FIG. 3 is a drive-side side view of the sweepings collection housing with its support frame.
Figure 4:
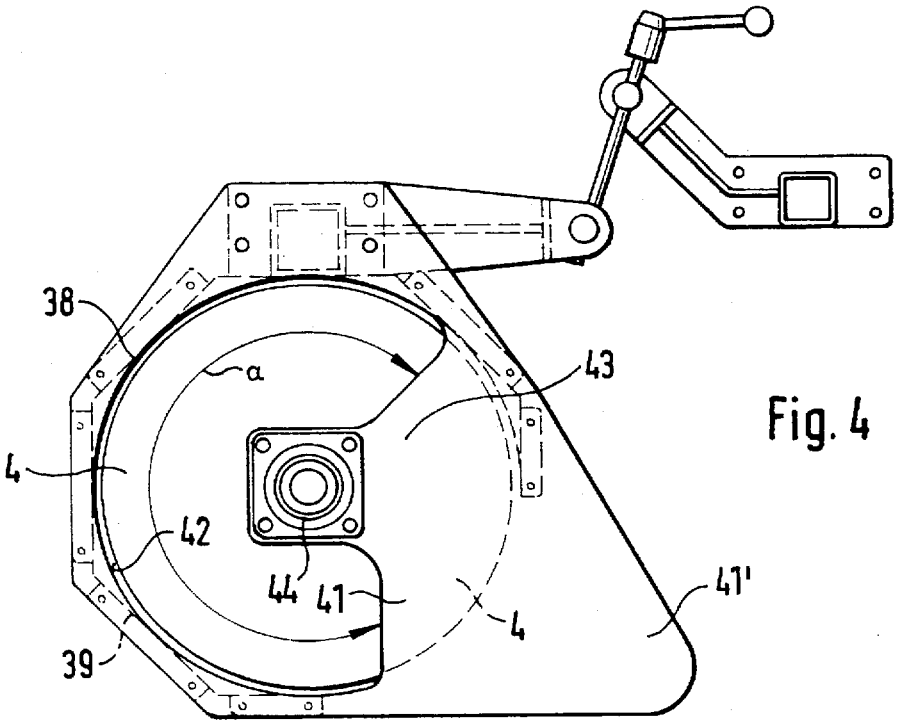
FIG. 4 is a discharge-side side view of the sweepings collection housing.
Figure 5:
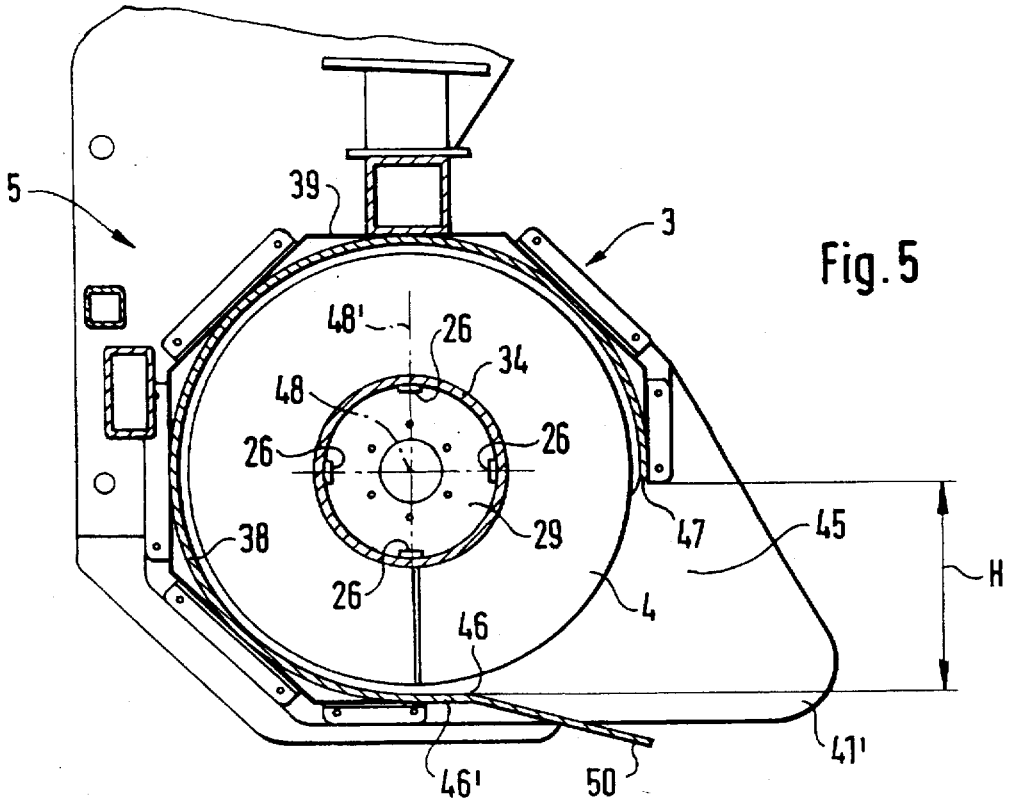
FIG. 5 is an enlarged sectional view of the sweepings collection housing with the feed screw arranged therein.
Figure 6:
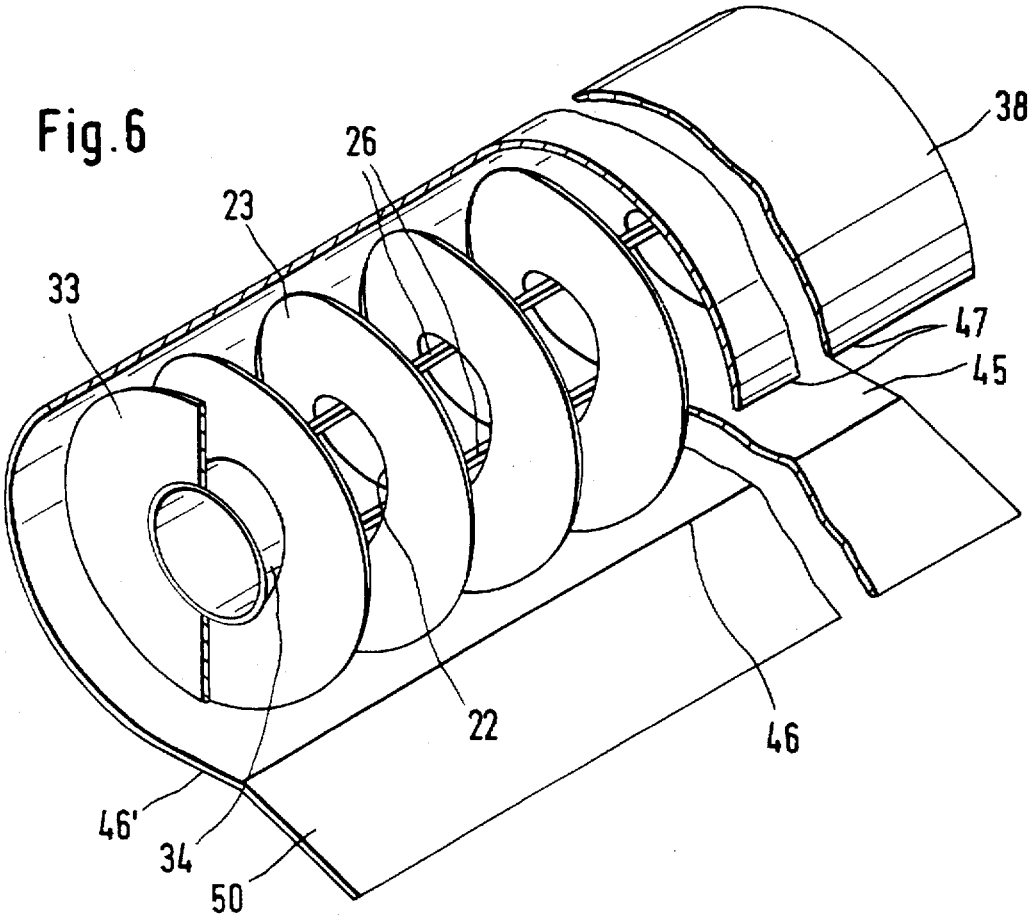
FIG. 6 is a partially cutaway parallel perspective view of the collection housing with the feed screw located therein.
Figure 7:
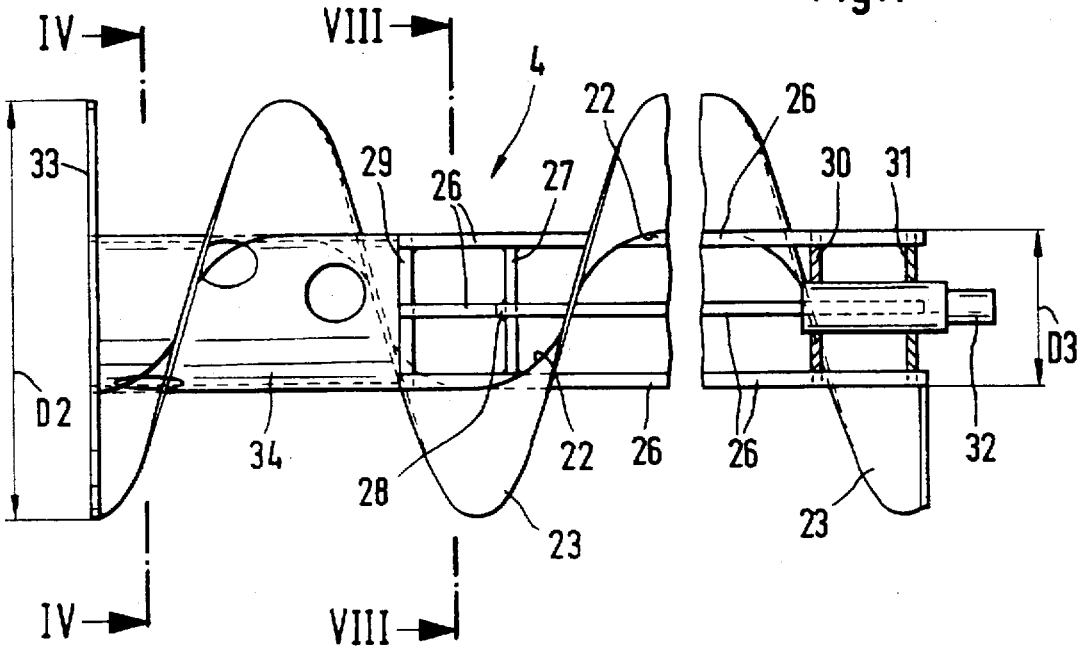
FIG. 7 shows a front view of the feed screw in a foreshortened representation.

The rolling bearing 44 of the feed screw accommodating the axle journal 32 is located in the rest of the wall segment 43. The front or side walls 40 and 41 (FIGS. 3 and 4) are provided with respective triangular extensions 40' and 41", which are arranged at the level of a charging opening 45 of the sweepings collection housing 3 and of the jacket tube 38 and are directed toward the lower area of the bristle roller 2 and extensively close the space located between the bristle roller 2 and the charging opening 45 on the front side.

The charging opening 45 of the jacket tube 38 has a vertical extension H which approximately corresponds to the initial bristle length of the bristle roller 2 and equals about 20 to 25 cm in the case of the dimensions indicated as an example. The lower axis-parallel limiting edge 46 of the charging opening 45 is located at the level of the lowest point of the jacket tube 38, and a short wall section 46' located between the lower limiting edge 46 and the vertical plane 48' of the screw axis 48 extends horizontally. The upper, likewise axis-parallel limiting edge 47 is located approximately at the level of the feed screw axis 48. Thus, the charging opening 45 extends approximately over one fourth of the circumference of the jacket tube, and the minimum width of the charging opening 45 should be about one fifth of the circumference of the jacket tube for fluidic reasons.

The lower limiting edge 46 of the charging opening 45 is joined by a baffle plate 50, which extends obliquely downward against the bristle roller 2 and is provided with a flexible bottom strip 51. This bottom strip 51 usually consists of a rubber plate, which lies on the traffic area 52 to be cleaned in the working position of the sweeping device.

The bristles 55 of the bristle roller 2 are arranged, extending radially in a closely packed arrangement and distributed uniformly over the circumference and over the length, on a central shaft, not visible in the drawing, and are surrounded on the top side by a hood-like protective housing 56, which ends on the rear side of an end edge 57 approximately at the level of the bristle roller axis 58, while the opposite end edge 59 of the protective housing 56 lies above the bristle roller axis 58 by about half the radius of the bristle roller 2 on the side facing the feed screw 4.

As is shown in FIG. 2, a gap 60, which is closed by an arc-shaped cover 61 preferably consisting of a rubber plate, is located between the upper end edge 59 of the protective housing 56 and the sweepings collection housing 3. The cover 61 is fastened to an obliquely downwardly extending wall section 62 of the protective housing 56, and with its loose end section 62, it lies elastically on a likewise obliquely downwardly directed section 63 of the sheet metal wall 39 surrounding the jacket tube 38. This elastic cover 61 extends over the entire length of the housing and prevents sweepings from being thrown out in the upward direction through the gap 60. At the same time, it also prevents the air flow generated by the bristle roller 2 from escaping vertically at this point.

The elasticity of this cover 61 is necessary because the bristle roller 2 with its protective housing 56 must be vertically adjustable in relation to the feed screw 4 and its sweepings collection housing 3 in order to make allowance for the wear-related reduction in the length of the bristles.

To achieve not only a mechanical sweeping effect of the bristle roller, but also that loose, fine granular, lightweight or dust-like sweepings, which are located in small depressions of the pavement surface, will also be caught and delivered into the sweepings collection housing, 3, the bristle roller 2 operates at such a speed of rotation that in the area located between it and the charging opening 45 of the sweepings collection housing 3/38, it generates an air flow, indicated by a set of direction arrows in FIG. 2, which continues in a channeled pattern in the sweepings collection housing 3/38, which acts as a feeding trough and as a flow channel at the same time, up to the lateral discharge opening 42 of this sweepings collection housing. Under the given conditions, such a speed of rotation is between a threshold value of 380 rpm and a maximum of about 1,500 rpm, and it may be varied within this range of speeds of rotation depending on the speed of travel and the type of the dirt to be removed from the traffic area 52 to be cleaned. A standard speed of rotation, which is optimal for the most frequent applications, is about 550 rpm. Experience has shown that the speed of travel of the utility vehicle 9, at which the sweeping device 1 moves over the traffic area 52 to be cleaned, plays a certain role as well. The speed of travel will have to be reduced in the case of massive dirt accumulation, while the speed of rotation of the bristle roller 2 is to be increased. The use of a separate, controllable drive for the bristle roller is advantageous in this connection. The feed screw may also be provided with such a separate hydraulic drive. It is favorable to drive the feed screw 4 provided with the dimensions indicated at a speed of rotation that is about half the speed of rotation of the bristle roller 2, and the direction of rotation of both the bristle roller 2 and the feed screw 4 is opposite the direction of rotation of the running wheels 16 and of the wheels of the vehicle.

It is also important for the air flow, which produces the aerodynamic cleaning effect and is generated by the bristle roller 2, to be able to continue possibly unhindered within the sweepings collection housing 3/38 to the discharge opening 42 of the said sweepings collection housing, and the above-described design of the feed screw 4, whose sheet metal coil 23 surrounds a central, quasi-cylindrical hollow space 22 extending over nearly the entire length of the screw, has a highly advantageous effect.

It was found that the sweeping device designed and equipped according to the present invention offers considerable advantages, especially in terms of performance, over the prior-art sweeping devices with a relatively lightweight design, and that there is no appreciable increase in the wear of the sweeping bristles despite the relatively high working speeds of the bristle roller 2.

While a specific embodiment of the invention has been shown and described in detail to illustrate the application of the principles of the invention, it will be understood that the invention may be embodied otherwise without departing from such principles.

What is claimed is:

1. A sweeping device for utility vehicles for cleaning a traffic area, comprising:

a rotating bristle roller driven by a motor;

a protective housing covering said bristle roller on a top side;

feeding means arranged directly in front of said roller with respect to a direction of travel, said feeding means for receiving material directed toward said feeding means by said rotating bristle roller, said feeding means comprising a feed screw which extends in parallel to said bristle roller, said feeding means including a motor driving said feed screw, a sweepings collection housing arranged around said feed screw and defining a rear charging opening extending over a length of said bristle roller, said sweepings collection housing defining a discharge opening at an end of said feed screw, wherein said sweepings collection housing has under said charging opening an obliquely downwardly directed baffle plate with a flexible bottom strip, said protective housing and said sweepings collection housing defining a gap, said feed means including a cover closing said gap, said bristle roller having an initial diameter (D1) of from about 30 cm to 100 cm and an initial bristle length of from about 10 cm to 40 cm, said bristle roller being driven at a speed of rotation, and said protective housing and said sweepings collection housing being shaped to define air flow means for generating air flow in an area located between said bristle roller and said charging opening of said sweepings collection housing, said air flow continuing up to said discharge opening of said sweepings collection housing, said sweepings collection housing forming simultaneously both a feed cup and a flow channel.

2. A sweeping device in accordance with claim 1, wherein said feed screw comprises a radial sheet metal coil wound around a central, cylindrical hollow space, said cylindrical hollow space being in communication with said charge and discharge openings and forming part of said air flow means, a cylindrical, closed jacket tube forming part of said sweepings collection housing, said jacket tube surrounding an entire axial length of said feed screw, said jacket tube being positioned at a short radial distance from said feed screw, said charging opening being defined by said jacket tube, and extending over at least one fifth of a circumference of said jacket tube.

3. A sweeping device in accordance with claim 2, wherein said feed screw has an external diameter (D2), a diameter (D3) of said hollow space surrounded by said screw coil corresponds to about one third of said external diameter (D2) of said feed screw.

4. A sweeping device in accordance with claim 1, wherein said charging opening has a vertical dimension (H) approximately corresponding to said initial bristle length of said bristle roller.

5. A sweeping device in accordance with claim 4, wherein a cylindrical, closed jacket tube forms part of said sweepings collection housing, said jacket tube surrounding an entire axial length of said feed screw, said jacket tube being positioned at a short radial distance from said feed screw, a lower limiting edge of said charging opening being located at a level of a lowest point of said jacket tube and an upper limiting edge of said charging opening is arranged approximately at a level of a screw axis.

6. A sweeping device in accordance with claim 1, wherein speed of rotation of said bristle roller is above a threshold value of about 350 rpm.

7. A sweeping device in accordance with claim 1, wherein said bristle roller has an initial diameter (D1), said feed screw has an external diameter (D2) that corresponds at least to three fourths of said initial diameter (D1) of said bristle roller.

8. A sweeping device in accordance with claim 1, wherein said bristle roller has a working speed of rotation, said motor driving said feed screw drives said feed screw approximately at a speed corresponding to half said working speed of rotation of said bristle roller.

9. A sweeping device in accordance with claim 1, wherein said discharge opening is at least as large as half of a cross-sectional area of said sweepings collection housing.

10. A sweeping device in accordance with claim 1, wherein said bristle roller has a lower area: said sweepings collection housing has a closed side wall located at a beginning of delivery of said feed screw and has, at a level of said charging opening, an extension which is directed toward said lower area of said bristle roller and substantially closes a space located between said bristle roller and said charging opening on a front side.

11. A sweeping device for utility vehicles, the device comprising:

a rotating bristle roller mounted on the vehicle and creating an air flow;

a protective housing covering said bristle roller;

feeding means arranged ahead of said bristle roller with respect to a direction of travel of the vehicle, said feeding means for receiving sweepings directed by said rotating bristle roller, said feeding means comprising a feed screw transporting the sweepings to an axial end of said feed screw, a feed housing arranged around said feed screw and defining a charging opening extending over an axial length of said bristle roller, said feed housing defining a discharge opening at an end of said feed screw, said feed housing and said protective housing being connected and shaped to form an air flow means for guiding said air flow from said bristle roller into said charging opening and axially out of said discharge opening.

12. A sweeping device in accordance with claim 11, wherein:

said air flow means includes a cylindrical hollow space radially inside said feed screw, said cylindrical hollow space being in communication with said charge and discharge openings.

13. A sweeping device in accordance with claim 12, wherein:

said airflow means includes said feed screw having an external diameter (D2), and a diameter (D3) of said cylindrical hollow space corresponding to about one third of said external diameter (D2) of said feed screw.

14. A sweeping device in accordance with claim 11, wherein:

said air flow means includes a cylindrical closed jacket tube forming part of said feed housing, said jacket tube having a shape following a shape of said feed screw and being positioned adjacent a circumference of said feed screw, said charging opening being defined by said jacket tube, said jacket tube extending over at least three fourths of said circumference of said feed screw.

15. A sweeping device in accordance with claim 14, wherein:

said feed screw has a screw axis;

said air flow means includes a lower limiting edge of said charging opening being located at a level of a lowest point of said jacket tube and an upper limiting edge of said charging opening being arranged approximately at a level of said screw axis.

16. A sweeping device in accordance with claim 11, wherein:

said air flow means includes said charging opening having a vertical dimension (H) approximately corresponding to an initial bristle length of said bristle roller.

17. A sweeping device in accordance with claim 1, wherein:

said airflow means includes said bristle roller having an initial diameter (D1) and said feed screw having an external diameter (D2) corresponding to at least three fourths of said initial diameter (D1) of said bristle roller.

18. A sweeping device in accordance with claim 11, wherein:

said airflow means includes said bristle roller having a speed of rotation, and a rotation speed of said feed screw being approximately half said speed of rotation of said bristle roller.

19. A sweeping device in accordance with claim 11, wherein:

said airflow means includes said discharge opening being at least as large as half of a cross-sectional area of said feed housing.

20. A sweeping device in accordance with claim 11, wherein:

said airflow means includes said feed housing having a closed side wall located at a beginning of delivery of said feed screw.

* * * * *